US006805048B2

(12) United States Patent
Pearson et al.

(10) Patent No.: US 6,805,048 B2
(45) Date of Patent: Oct. 19, 2004

(54) METHOD OF MARKING A SUBSTRATE USING AN ELECTRET STENCIL

(75) Inventors: Scott D. Pearson, Woodbury, MN (US); Vivek Bharti, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/231,567

(22) Filed: Aug. 30, 2002

(65) Prior Publication Data

US 2004/0040454 A1 Mar. 4, 2004

(51) Int. Cl.[7] ..... B41M 1/12; B41L 13/12
(52) U.S. Cl. ..... 101/129; 101/114; 101/41
(58) Field of Search ..... 101/41, 483, 368, 101/401.1, 114, 127, 129, 35

(56) References Cited

U.S. PATENT DOCUMENTS

| | | | | |
|---|---|---|---|---|
| 2,651,871 | A | | 9/1953 | Lynden |
| 3,264,272 | A | | 8/1966 | Rees |
| 3,487,610 | A | | 1/1970 | Brown et al. |
| 3,665,889 | A | | 5/1972 | Wagenwood |
| 3,783,588 | A | | 1/1974 | Hudis |
| 3,834,823 | A | | 9/1974 | Seregely et al. |
| 3,845,163 | A | | 10/1974 | Murch |
| 3,918,393 | A | | 11/1975 | Hahn |
| 3,922,457 | A | | 11/1975 | Barnwell et al. |
| 3,949,132 | A | | 4/1976 | Seregely et al. |
| 3,998,325 | A | | 12/1976 | Kulka |
| 4,014,091 | A | | 3/1977 | Kodera et al. |
| 4,048,036 | A | | 9/1977 | Prucnal |
| 4,129,669 | A | | 12/1978 | Lopez |
| 4,225,369 | A | | 9/1980 | Felchlin |
| 4,275,112 | A | | 6/1981 | Savage, Jr. |
| 4,403,834 | A | | 9/1983 | Kley |
| 4,409,077 | A | * | 10/1983 | Sakiyama et al. ..... 522/167 |
| 4,455,205 | A | | 6/1984 | Olson et al. |
| 4,478,876 | A | | 10/1984 | Chung |
| 4,486,504 | A | | 12/1984 | Chung |
| 4,490,323 | A | | 12/1984 | Thomson |

(List continued on next page.)

FOREIGN PATENT DOCUMENTS

| | | |
|---|---|---|
| EP | 0 307 624 | 3/1989 |
| EP | 0 535 868 A1 | 4/1993 |
| EP | 0 825 020 A2 | 2/1998 |

(List continued on next page.)

OTHER PUBLICATIONS

"Atomic Force Microscopy", Handbook Of Analytical Methods For Materials, Materials Evaluation and Engineering, Inc., 2001, pp. 7–10.

(List continued on next page.)

*Primary Examiner*—Leslie J. Evanisko
(74) *Attorney, Agent, or Firm*—Bradford B. Wright

(57) ABSTRACT

A stencil comprises an electret film, wherein the film has at least one perforation having a perimeter that defines an area, and wherein the area is greater than or equal to about one square centimeter. Methods of marking a substrate using stencils of the present invention are also disclosed.

14 Claims, 1 Drawing Sheet

U.S. PATENT DOCUMENTS 4,491,508 A 1/1985 Olson et al.
4,500,116 A 2/1985 Ferro et al.
4,504,550 A 3/1985 Pook
4,513,049 A 4/1985 Yamasaki et al.
4,546,416 A 10/1985 Pemberton
4,623,438 A 11/1986 Felton et al.
4,626,263 A 12/1986 Inoue et al.
4,652,239 A 3/1987 Brimberg
4,663,214 A 5/1987 Coburn, Jr.
4,673,609 A 6/1987 Hill
4,741,119 A 5/1988 Baryla
4,746,576 A 5/1988 Ozu et al.
4,820,536 A 4/1989 Lippincott et al.
4,833,017 A 5/1989 Benoit
4,883,556 A 11/1989 Leavitt, Sr. et al.
4,885,332 A 12/1989 Bilkadi
4,925,905 A 5/1990 Boeckh et al.
4,983,923 A 1/1991 Taniguchi
4,988,123 A 1/1991 Lin et al.
4,992,121 A 2/1991 Rubino
4,996,110 A 2/1991 Tanuma et al.
5,010,671 A 4/1991 Stonehouse
5,024,898 A 6/1991 Pitts et al.
5,037,702 A 8/1991 Pitts et al.
5,102,171 A 4/1992 Saetre
5,104,929 A 4/1992 Bilkadi
5,113,921 A 5/1992 Pool
5,139,804 A 8/1992 Hoffman
5,153,064 A * 10/1992 Hefele ..... 428/355 EN
5,186,707 A 2/1993 Barta
5,198,301 A 3/1993 Hager et al.
5,207,581 A 5/1993 Boyd
5,225,257 A 7/1993 Brant
5,252,071 A 10/1993 Hansard
5,256,176 A 10/1993 Matsuura et al.
5,258,214 A 11/1993 Cooledge et al.
5,258,225 A 11/1993 Katsamberis
5,292,560 A 3/1994 German
5,296,170 A 3/1994 Sugimoto et al.
5,324,784 A 6/1994 Fujita et al.
5,334,431 A 8/1994 Longtin
5,354,996 A 10/1994 Griffith et al.
5,387,304 A 2/1995 Berner et al.
5,391,210 A 2/1995 Bilkadi et al.
5,402,265 A 3/1995 Jahoda et al.
5,403,025 A 4/1995 Shanley
5,403,879 A 4/1995 Kim et al.
5,415,911 A 5/1995 Zampa et al.
5,460,087 A 10/1995 Ogorzalek
5,477,784 A 12/1995 Floegel
5,486,949 A 1/1996 Schrenk et al.
5,525,177 A 6/1996 Ross
5,558,809 A 9/1996 Groh et al.
5,601,431 A 2/1997 Howard
5,620,764 A 4/1997 Schwarz et al.
5,654,049 A 8/1997 Weder et al.
5,677,050 A 10/1997 Bilkadi et al.
5,698,621 A 12/1997 Nguyen et al.
5,741,389 A 4/1998 Yoshino
5,755,338 A 5/1998 vom Braucke et al.
5,756,153 A 5/1998 Plourde
5,766,398 A 6/1998 Cahill et al.
5,780,153 A 7/1998 Chou et al.
5,783,120 A 7/1998 Ouderkirk et al.
5,795,425 A 8/1998 Brault et al.
5,807,624 A 9/1998 Anderson et al.
5,825,543 A 10/1998 Ouderkirk et al.
5,826,851 A 10/1998 Arbisi
5,837,375 A 11/1998 Brault et al.
5,882,519 A 3/1999 Chou et al.
5,888,615 A 3/1999 Mascarenhas et al.
5,890,428 A 4/1999 Hetz
5,893,229 A 4/1999 Werner
5,899,010 A 5/1999 Peck
5,904,985 A 5/1999 Ward et al.
5,914,158 A 6/1999 McGuiness
5,916,650 A 6/1999 Rosenbaum et al.
5,922,159 A 7/1999 Cahill
5,967,031 A * 10/1999 Gauss ..... 101/129
5,968,666 A 10/1999 Carter et al.
5,976,208 A 11/1999 Rousseau et al.
5,989,685 A 11/1999 Hockaday
6,001,299 A 12/1999 Kawabe et al.
6,001,482 A 12/1999 Anderson et al.
6,030,002 A 2/2000 Charley et al.
6,038,803 A 3/2000 Wilkins
6,112,425 A 9/2000 Nelson et al.
6,139,967 A 10/2000 Tozuka et al.
6,145,512 A 11/2000 Daley
6,171,681 B1 1/2001 Mascarenhas et al.
6,197,397 B1 3/2001 Sher et al.
6,203,885 B1 3/2001 Sher et al.
6,208,445 B1 3/2001 Reime
6,250,219 B1 6/2001 Garvin
6,251,500 B1 6/2001 Varga et al.
6,254,386 B1 7/2001 Ohmes
6,254,711 B1 7/2001 Bull et al.
6,258,200 B1 7/2001 Kassab
6,265,074 B1 7/2001 Shah et al.
6,272,779 B1 8/2001 Seiber et al.
6,284,339 B1 9/2001 Floegel et al.
6,309,750 B1 10/2001 Revill
6,375,864 B1 4/2002 Phillips et al.
6,383,651 B1 5/2002 Weinert et al.
6,397,458 B1 6/2002 Jones et al.
6,423,247 B1 7/2002 Fukushima et al.
6,423,418 B1 7/2002 Callicott et al.
6,436,218 B2 8/2002 Sher et al.
6,484,328 B1 * 11/2002 Frazier ..... 4/661
6,579,603 B1 6/2003 Weder
6,635,077 B2 10/2003 Grissmeyer et al.
2001/0004484 A1 6/2001 Sher et al.
2001/0006714 A1 7/2001 Bull et al.
2001/0010367 A1 8/2001 Burnell-Jones
2001/0024720 A1 9/2001 Sweet et al.
2001/0051280 A1 12/2001 Callicott et al.
2002/0034608 A1 3/2002 Aeling et al.
2002/0088535 A1 7/2002 Hsu et al.
2002/0090480 A1 7/2002 Hsu et al.
2002/0090509 A1 7/2002 Hsu et al.
2002/0096985 A1 7/2002 Hazzard

FOREIGN PATENT DOCUMENTS

GB 1 366 343 9/1974
GB 2 231 551 A 11/1990
JP 48-51298 7/1973
JP 50-26040 B 8/1975
JP 51-23040 7/1976
JP 51-48278 12/1976
JP 54-108299 6/1979
JP 57-21472 2/1982
JP 2072074 3/1990
JP 05-253416 A 10/1993
JP 7-24461 9/1995
JP 10-321468 12/1998
WO WO 93/07535 4/1993
WO WO 94/25294 11/1994
WO WO 97/47481 12/1997
WO WO 98/55297 12/1998
WO WO 99/29502 6/1999
WO WO 99/31534 6/1999

| | | |
|---|---|---|
| WO | WO 99/65679 | 12/1999 |
| WO | WO 01/22858 A1 | 4/2001 |
| WO | WO 01/30588 A1 | 5/2001 |
| WO | WO 01/53421 A1 | 7/2001 |
| WO | WO 01/80205 A1 | 10/2001 |
| WO | WO 02/24463 A1 | 3/2002 |
| WO | WO 02/34507 A1 | 5/2002 |

OTHER PUBLICATIONS

Instruction, Operation, and Maintenance Manual, "Chargemaster® Pinner™ Arc Resistant Charging Bar", SIMCO, Publication No. 5200710, Oct. 1997.
Product Literature: ClingZ®: electrostatically charged printable media by Permacharge Corporation, Web Page www.clingz.com (Printed Oct. 21, 2002).
Product Literature: ClingZ®, Product Concept Examples/ClingZ® Advantages, Web Page www.permacharge.com (No Date).
Product Literature: ClingZ®, Applications, www.permacharge.com (Printed Jul. 14, 2002).
Product Literature: ClingZ®, Comparisons of ClingZ®, www.permacharge.com (Printed Jul. 14, 2002).
Product Literature: ClingZ®, General Printing Guidelines, www.permacharge.com (Printed Jul. 14, 2002).
Product Literature: ClingZ®, Flexo Printing Guidelines, www.permacharge.com (Printed Jul. 14, 2002).
Product Literature: ClingZ®, Guidelines For Graphic Design Of ClingZ® Products, www.permacharge.com (Printed Aug. 19, 2002).
Product Literature: ClingZ®, Offset Printing Guidelines, www.permacharge.com (Printed Jul. 14, 2002).
Product Literature: ClingZ®, Screen Printing Guidelines, www.permacharge.com (Printed Jul. 14, 2002).
Product Literature: ClingZ®, The World According to ClingZ®, www.permacharge.com (Printed Jul. 14, 2002).
van der Kolk et al., "Coating Evaluations of Decorative PVD Finishes", 1998 Society of Vacuum Coaters 505/856–7188, pp. 45–50.
Product Sample: "Color–Clings® Glow In The Dark" (No Date).
Giacometti et al., "Corona Charging of Polymers", IEEE Transactions on Electrical Insulation, vol. 27, No. 5, Oct. 1992, pp. 924–943.
Product Literature: "Display Graphics—Electrostatic cling film", www.screenweb.com (Printed Jul. 9, 2002).
Product Literature: "Highlights from the Leitz programme.", Easy–Flip Products, www.leitz.com (Printed Oct. 21, 2002).
Product Literature: "Welcome to the Leitz online catalogue.", Easy–Flip® System, www.leitz.com (Printed Oct. 21, 2002).
Product Literature: "Folio Contact", Nordenia Company, www.nordenia.com (Printed Jun. 29, 2002).
Product Literature: "Folio Contact", The Indispensable Business Accessory, Nordenia Company, www.nordenia.com (Not Dated).
Product Literature from Folio Contact Packaging: Nordenia Company (Not Dated).
Product Literature: "Jet Folio", Nordenia Company, www.nordenia.com (Printed Oct. 21, 2002).
Product Literature: "Glow in the Dark Photoluminous Signs", www.glo–net.com (Printed May 10, 2002).
Product Literature: "GLOWSTICKFACTORY.COM™", Flow In The Dark, www.glowstickfactory.com (Printed May 10, 2002).
Product Literature: "Plastiprint Products—Static Cling vinyls", www.plastiprint.com (Printed Aug. 30, 2002).
Product Literature: "Manual of Luminous Pro–Glow Pigment Powders", ProGlow Mfg. Company, Inc., Mar. 17, 2001.
Product Literature: "Write On–Cling Sheets—Notes That Cling to Walls", Avery Dennison (Not Dated).
Product Literature: "Write–On Cling Sheets™", Pad, www.avery.com (Printed Jul. 14, 2002).
Product Literature: "Write–On Cling Sheets™"; Rolled, www.avery.com (Printed Jul. 14, 2002).
Product Literature: "Write–On Cling Sheets™", Idea Recipe, www.avery.com (Printed Jul. 30, 2002).
U.S. patent application Ser. No. 10/231,570, filed Aug. 30, 2002, Method of Adhering a Film and Articles therefrom.
U.S. patent application Ser. No. 10/232,259, filed Aug. 30, 2002, Method for Electrostatically Adhering an Article to a Substrate.
U.S. patent application Ser. No. 10/231,530, filed Aug. 30, 2002, Perforated Electret Articles and Method of Making the Same.
U.S. patent application Ser. No. 10/231,568, filed Aug. 30, 2002, Method of Making Erasable Articles therefrom.
U.S. patent application Ser. No. 10/231,506, filed Aug. 30, 2002, Phosphorescent Electret Films and Methods of Making the Same.
"Go Writel Products", InVision Enterprises, Inc. [on line], [retrieved from the internet on Nov. 4, 2003], URL <http://mygowrite.com>, 5 pages.
U.S. patent application Ser. No. 10/613,249, Jul. 3, 2003, Cling Articles.
"Static Clings", Converter, vol. 37, Issue 12, Dec. 2000, Faversham House Group, Ltd., p. 14.

* cited by examiner

METHOD OF MARKING A SUBSTRATE USING AN ELECTRET STENCIL

TECHNICAL FIELD

The present invention relates to stencils and stenciling methods.

BACKGROUND

A stencil is a, typically impervious, film or sheet of material perforated with one or more designs (e.g., lettering or an artistic shape). As used, a stencil is typically contacted with a surface of a substrate, and a colorant (e.g., ink, paint, glaze, or metallic powder) is applied to the surface through perforation(s) in the stencil. After application of the colorant, the stencil is removed from the surface leaving behind a corresponding design on the surface. By this method, decorative designs are frequently applied to walls, ceilings, papers, ceramics, metals, glass, and wood furniture to enhance the attractiveness of an area or object and/or as a form of recreation.

While applying the colorant to the surface of the substrate, any movement of the stencil typically degrades the quality of the resulting design. Common methods for securing stencils to the substrate surface include application of hand pressure, taping the stencil to the surface of the substrate, and/or using an adhesive between the stencil and the surface of the substrate.

Stencils that are secured by taping around the perimeter are often difficult and awkward to secure because sufficient area must be left around the stencil to tape to the substrate. They are also prone to unacceptable shifting of the template, particularly in design areas that are masked by narrow elements of the stencil sheet or require interior projections, unless the template is made very rigid. Rigid stencils are generally difficult to use with rounded or uneven substrate surfaces.

The abovementioned methods using adhesives can be awkward to carry out, may cause damage to substrates upon their removal (e.g., paint removal), or leave a residue that must be separately removed. Also, adhesives may not adhere well to substrates that are covered with a layer of extraneous material (e.g., dust).

Plasticized vinyl films (commonly referred to as "cling vinyl" films) have been used as stencils. These stencils typically adhere well to smooth substrates, but generally do not adhere well to rough or dusty surfaces (e.g., painted drywall) or porous or uneven surfaces (e.g., wood, brick).

Electret films, that is, films having a permanent or semi-permanent electrostatic charge (i.e., electret charge), have been prepared using a variety of thermoplastic polymers. Electret films generally exhibit electrostatic attraction (i.e., static cling) to the surfaces of substrates allowing the films to be removably adhered to such surfaces.

Polymeric electret films, in sheet or roll form, with lines of minute perforations to facilitate tearing are known and are commercially available. However, such lines of perforations are separated from each other by a relatively large distance (typically the length of a sheet), and are not suitable for use as a stencil.

It would be desirable to have stencils that overcome at least some of the deficiencies listed above.

SUMMARY

In one aspect, the present invention provides a stencil comprising an electret film having a first major surface, a second major surface opposed to the first major surface, and at least one perforation extending through the film and connecting the first and second major surfaces, wherein the perforation has a perimeter that defines an area, and wherein the area is greater than or equal to about one square centimeter.

In another aspect, the present invention provides a method for marking a substrate comprising:

providing an electret film having first and second opposed major surfaces, the electret film having at least one perforation therethrough;

providing a substrate having a surface;

electrostatically and removably adhering the first major surface of the electret film to the surface of the substrate;

applying a medium to the surface of the substrate through said at least one perforation; and removing the electret film from the surface of the substrate.

In another aspect, the present invention provides an imaged article prepared according to the abovementioned method.

Stencils according to the present invention are typically easily positioned, repositionable, easily removable without leaving any adhesive residue, and securely held to the substrate during stenciling.

As used herein:

"film" includes sheets and strips; and

"(meth)acryl" includes acryl and methacryl.

DETAILED DESCRIPTION

Electret stencils according to the present invention comprise an electret film having at least one perforation therethrough.

Figure 1:
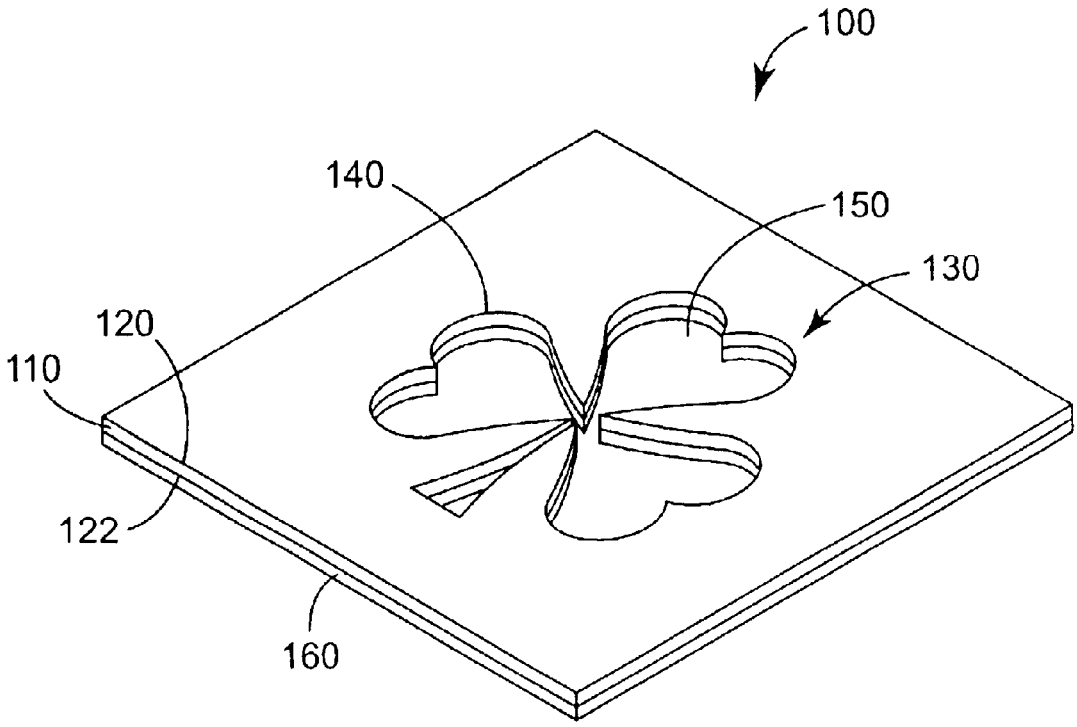
FIG. 1 is a perspective view of an exemplary stencil according to one embodiment of the present invention.

An embodiment of an electret stencil according to the present invention is illustrated in FIG. 1, wherein electret stencil 100 comprises electret film 110 having first and second opposed major surfaces 120 and 122, respectively. Perforation 130 extends through electret film 110 and contacts first major surface 120 and second major surface 122. Perforation 130 has perimeter 140 that defines area 150, which is greater than or equal to about one square centimeter. Optional carrier sheet 160 contacts second major surface 122.

In some embodiments of the present invention, the electret film may be a unitary piece. In other embodiments of the present invention, the electret film may be a combination of at least two separate film pieces that are joined together (e.g., adhesively and/or electrostatically).

Any thermoplastic polymeric material that can maintain an electret charge can be used to make the electret film including fluorinated polymers (e.g., polytetrafluoroethylene, polyvinylidene fluoride, tetrafluoroethylene-hexafluoropropylene copolymers, vinylidene fluoride-trifluorochloroethylene copolymers), polyolefins (e.g., polyethylene, polypropylene, poly-4-methyl-1-pentene, propylene-ethylene copolymers), copolymers of olefins and other monomers (e.g., ethylene-vinyl acetate copolymers, ethylene-acrylic acid copolymers, ethylene-maleic acid anhydride copolymers, propylene-acrylic acid copolymers, propylene-maleic acid anhydride copolymers, 4-methyl-1-pentene-acrylic acid copolymers, 4-methyl-1-pentene-maleic acid anhydride copolymers), ionomers (e.g., ethylene-acrylic acid or ethylene-methacrylic acid copolymers with acidic protons replaced by $Na^+$, $K^+$, $Ca^{2+}$, $Mg^{2+}$, or $Zn^{2+}$ ions), polyesters (e.g., polyethylene terephthalate), unplasticized polyvinyl chloride, polyamides (e.g., nylon-6, nylon-6,6), polycarbonates, polysulfones, blends and mixtures thereof, and the like. Desirably, the thermoplastic polymeric material comprises at least one of polypropylene or a poly(ethylene-co-methacrylic acid) ionomer, more desirably a poly(ethylene-co-methacrylic acid) ionomer, more desirably a zinc poly (ethylene-co-methacrylic acid) ionomer.

Many poly(ethylene-co-(meth)acrylic acid) ionomers are commercially available as pellets and/or films, for example, as marketed under the trade designation "SURLYN" (e.g., lithium poly(ethylene-co-methacrylic acid) ionomers such as "SURLYN 7930", "SURLYN 7940"; sodium poly (ethylene-co-methacrylic acid) ionomers such as "SURLYN 1601", "SURLYN 8020", "SURLYN 8120", "SURLYN 8140", "SURLYN 8150", "SURLYN 8320", "SURLYN 8527", "SURLYN 8660", "SURLYN 8920", "SURLYN 8940", "SURLYN 8945"; zinc poly(ethylene-co-methacrylic acid) ionomers such as "SURLYN 1705-1", "SURLYN 1706", SURLYN 6101", SURLYN 9020", "SURLYN 9120", "SURLYN 9150", "SURLYN 9320W", "SURLYN 9520", "SURLYN 9650", "SURLYN 9720", "SURLYN 9721", "SURLYN 9910", "SURLYN 9945", "SURLYN 9950", "SURLYN 9970", "SURLYN PC-100") by E.I. du Pont de Nemours & Company, Wilmington, Del.; or as marketed under the trade designation "IOTEK" (e.g., sodium poly(ethylene-co-acrylic acid) ionomers such as "IOTEK 3110", "IOTEK 3800", or "IOTEK 8000", and zinc poly(ethylene-co-acrylic acid) ionomers such as "IOTEK 4200") by ExxonMobil Corporation, Houston, Tex. Further details of useful poly(ethylene-co-(meth)acrylic acid) ionomers are described in, for example, commonly assigned U.S. Patent Application entitled "METHOD OF ADHERING A FILM AND ARTICLES THEREFROM" (Bharti et al.), Ser. No. 10/231,570, filed Aug. 30, 2002, the disclosure of which is incorporated herein by reference.

Optionally, one or more additives can be compounded into the thermoplastic polymeric material. Exemplary optional additives include antioxidants, light stabilizers (e.g., as available from Ciba Specialty Chemicals, Tarrytown, N.Y. under the trade designations "CHIMASSORB 2020", "CHIMASSORB 119", "CHIMASSORB 944", "TINUVIN 783", or "TINUVIN C 353"), thermal stabilizers (e.g., as available from Ciba Specialty Chemicals under the trade designations "IRGANOX 1010", "IRGANOX 1076") fillers (e.g., inorganic or organic), charge control agents (e.g., as described in U.S. Pat. No. 5,558,809 (Groh et al.)), fluorochemical additives (e.g., as described in U.S. Pat. No. 5,976,208 (Rousseau et al.) and U.S. Pat. No. 6,397,458 (Jones et al.)), glass beads, glass bubbles, colorants (e.g., dyes, pigments), and fragrances. To allow formation of high levels of charge density, additives (e.g., antistatic agents) that can impart electrical conductivity to the thermoplastic polymeric material are desirably minimized or avoided.

Thermoplastic polymeric materials may be obtained commercially in film form or melt-extruded (e.g., from pellets) as a film using procedures well known in the film art. Typically, the thickness of the electret film is in the range of from about 10 to about 2500 micrometers, although thinner and thicker films may also be used. Desirably, the electret film has a thickness in the range of from about 25 to about 310 micrometers, more desirably in the range of from about 50 to about 110 micrometers.

Electret films can be readily obtained from commercial sources or prepared by a variety of methods that are well known in the art. For details on methods for making electret films see, for example, "Electrets", G. M. Sessler (ed.), Springer-Verlag, N.Y., 1987. Exemplary methods of forming electrets are well known in the art and include thermal electret, electroelectret (e.g., direct current (i.e., DC) corona discharge), radioelectret, magnetoelectret, photoelectret, and mechanical electret forming methods as described in, for example, U.S. Pat. No. 5,558,809 (Groh et al.), the disclosure of which is incorporated herein by reference. Typically, electret films utilized in practice of the present invention have an electret charge density of greater than about 0.05 nanocoulombs per square centimeter ($nC/cm^2$), preferably greater than about 0.5 $nC/cm^2$, more preferably greater than about 5 $nC/cm^2$. DC corona charging (e.g., as described in, for example, U.S. Pat. No. 6,001,299 (Kawabe et al.) and U.S. Pat. No. 4,623,438 (Felton et al.), the disclosures of which are incorporated herein by reference) is a desirable and convenient method for preparing electret films that are useful in practice of the present invention. Exemplary commercially available electret films include polypropylene electret films available under the trade designation "CLINGZ" from Permacharge Corporation, Rio Rancho, N.Mex.

Perforations in stencils of the present invention are desirably large and have an ornamental shape. Thus, stencils according to the present invention typically have at least one, desirably more than one, perforation having a perimeter that defines an area greater than or equal to about one square centimeter.

Desirably, at least one perforation in the stencil has a shape selected from the group consisting of an alphanumeric character, a regular geometric shape (e.g., a circle, a star, a regular polygon, a rhombus), a silhouette of an animal (e.g., a dog, a cat, a horse) silhouette of a portion of an animal (e.g., a head, a tail, a paw), a silhouette of a plant (e.g., a tree, a flower, a vine), and a silhouette of a portion of a plant (e.g., a leaf, a stem, a bloom).

In some instances, such as for large or complicated shapes, a desired shape may be made of two or more closely situated perforations separated by relatively thin strips of material.

Surfaces of stencils of the present invention may have a glossy or matte appearance. Glossy stencil surfaces typically adhere well to a substrate. Matte surfaces may aid in adhering the medium to the stencil.

Methods for perforating films and sheets are well known in the art and include, for example, die punching, perforating rolls, razor or knife cutting, laser cutting, and the like. Desirably, methods utilized to prepare electret stencils of the present invention do not give rise to burs or other protrusions at the edges of the perforations, as such burs may reduce the contact area of the electret stencil with a substrate to which it is electrostatically adhered.

Electret stencils of the present invention are typically useful for marking a substrate. Any solid substrate may be used in practicing the present invention. The substrate may be conductive or nonconductive. Substrates may have vertical and/or horizontal surfaces. Preferably, at least the portion of the surface of the substrate is substantially planar.

As used herein, the term "substantially planar" encompasses surfaces that are generally planar in appearance, optionally having minor irregularities, imperfections and/or warpage. The substrate may be painted or unpainted and/or finished or unfinished. Exemplary substrates include liners (e.g., papers, thermoplastic polymer films); multilayer optical films (e.g., as described in, for example, U.S. Pat. No. 5,825,543 (Ouderkirk et al.) and U.S. Pat. No. 5,783,120 (Ouderkirk et al.), the disclosures of which are incorporated by reference), architectural surfaces (e.g., floors, walls, ceilings), glass (e.g., windows, mirrors), metal, drywall, plaster, motor vehicles (e.g., automobiles, trucks, motorcycles), trailers (e.g., truck trailers), mobile homes, boats, furniture (e.g., wicker furniture), boxes, cabinets, mats, wall hangings, doors, dishes (e.g., glasses, plates, and ceramic dishes), ceramic tile, photographs, banners, balloons, signs, paper, and cloth. Preferably, the substrate is non-conductive (i.e., a dielectric), although this is not a requirement.

In one exemplary method for marking a substrate, a major surface of an electret film having at least one perforation therethrough, is contacted with (i.e., applied to) the surface of a substrate. The degree of adhesion of the stencil to the substrate at this stage is desirably such that the stencil adheres to the substrate, but can be slid relative to the substrate without damage to the stencil or the substrate (e.g., by hand). Thus, the electret film may, optionally, be positioned (e.g., by sliding the stencil relative to the substrate) and/or smoothed (e.g., to remove wrinkles or bubbles in the stencil) and to provide close contact between the substrate and regions of the electret film adjacent to the perimeter(s) of the perforation(s).

Optionally, at least one piece of masking material (e.g., having a perimeter that forms an ornamental shape) may be combined with at least one electret stencil to form a stencil kit. As used herein, the at least one piece of masking material may be adhered, desirably removably adhered, to the exposed substrate at least partially within a region defined by at least one perforation of the electret stencil. If employed, the masking material is desirably an electret film, more desirably an electret film having the same composition as the electret stencil, and may optionally be supplied on the same or a different backing sheet from the electret stencil.

Once the stencil has been removably adhered to the substrate in a desired position and orientation, the exposed surface of the stencil (and any optional masking film) is desirably rubbed, desirably with a film or cloth. During such rubbing, it is desirable that the stencil be prevented from shifting relative to the substrate. Exemplary suitable films and cloths that may be used for rubbing include paper, polymeric film, nonwoven cloths, woven cloths, and combinations thereof. Further details of rubbing procedures are described in, for example, commonly assigned U.S. Patent Application entitled "METHOD FOR ELECTROSTATICALLY ADHERING AN ARTICLE TO A SUBSTRATE" (Bharti et al.), Ser. No. 10/232,259, filed Aug. 30. 2002, the disclosure of which is incorporated herein by reference. Such rubbing typically serves to increase the level of shear adhesion between the electret film and the substrate.

Through this rubbing process, the stencil typically conforms tightly to the substrate, particularly around the edges of the perforations. Adhesion of the stencil to the substrate also typically increases, and may continue to increase for a period of time after rubbing is stopped. Thus, it is desirable to wait for a period of time (e.g., at least about 20 seconds) after discontinuing rubbing before application of the medium to the substrate. Any increase in adhesion between the stencil and the substrate caused by rubbing helps reduce lifting of portions of the stencil from the substrate during application of the medium.

Once the stencil is removably adhered to the substrate, a medium (which may be colored or colorless and transparent or opaque) is typically applied to regions of the surface of the substrate that are exposed through perforation(s) in the stencil. Exemplary useful media include colored media (e.g., pigments, chalks (including colored chalks), paints, inks, crayons, transfer sheets (including thermal transfer sheets and dry transfer sheets)); colorless media, for example, protective varnishes; etchants (e.g., glass etchants); and pressure-sensitive adhesives. If a pressure-sensitive adhesive is used as the medium, after application of the medium, and optionally after removal of the stencil from the substrate, the adhesive may be dusted with a particulate solid material (e.g., pigment, glitter, glass beads).

In some cases, it may be useful to apply more than one medium may be applied (e.g., a colorant and a varnish, or two colorants) to the substrate. After the medium has been applied, the stencil is typically removed (e.g., by peeling) from the substrate resulting in an image on the substrate corresponding to the shape of perforation(s) in the stencil.

Any method can be used to apply the medium to exposed regions of the substrate including rubbing (e.g., using a crayon, chalk, or a pencil), and/or painting (e.g., using a brush or spraying).

In order to prevent damage to the stencil during handling (e.g., repositioning and/or rubbing), stencils according to the present invention may be provided on an optional removable carrier sheet (desirably transparent or translucent). Exemplary carrier sheets include polymeric films and papers (including coated papers). In one embodiment, the optional removable carrier sheet may be removed prior to applying the stencil to the substrate. In another embodiment, the optional removable carrier sheet may be removed after applying the stencil to the substrate, but prior to any optional rubbing of the stencil. In another embodiment, the optional removable carrier sheet may be removed after applying and rubbing the stencil, but prior to applying the medium to the substrate.

If present, the optional removable carrier sheet may comprise any material, but is typically chosen such that removable carrier sheet can be removed from the stencil without causing removal of the stencil from any substrate to which it may be adhered. The optional removable carrier sheet may be opaque, translucent, or transparent. Preferably, the optional carrier sheet is transparent or translucent. Optionally, the optional removable carrier sheet may have markings (e.g., printed indicia) thereon. Exemplary suitable removable carrier sheets include paper and/or polymeric film. The optional carrier sheet may be continuous (i.e., not perforated), or the optional carrier sheet may have at least one perforation, desirably aligned with at least one perforation of the stencil.

In another embodiment, an optional secondary film or sheet may be contacted with the stencil after it is applied to a substrate and positioned, but prior to applying the medium to the substrate. In such an embodiment, the secondary film or sheet is desirably rubbed with paper or a cloth to provide close contact between the substrate and regions of the electret film adjacent to the perimeter(s) of the perforation(s). During such rubbing, it is desirable that the stencil be prevented from shifting relative to the substrate. Through this rubbing process, the stencil typically conforms tightly to the substrate, particularly around the edges of the perforations. Subsequent to rubbing, the optional secondary sheet is desirably removed from the stencil (e.g., by peeling) and the medium is applied through at least one perforation of the stencil to an exposed region of the substrate. Exemplary suitable optional secondary sheets and cloths that may be used include paper, polymeric film, or a combination thereof.

The present invention will be more fully understood with reference to the following non-limiting examples in which all parts, percentages, ratios, and so forth, are by weight unless otherwise indicated.

EXAMPLES

A decorative paint design was applied to a wood substrate using an electret stencil according to the following procedure:

Zinc polyethylene-methacrylic acid ionomer pellets (78 parts, obtained under the trade designation "SURLYN 1705-1" from E.I. du Pont de Nemours & Company, Wilmington, Del.), and 22 parts of a mixture of 15.4 parts titanium dioxide dispersed in 6.6 parts polyethylene (obtained under the trade designation "STANDRIDGE 11937 WHITE CONCENTRATE" from Standridge Color, Bridgewater, N.J.) were combined and extruded onto a polyester liner (2 mils (50 micrometers) thickness) using a 2.5 inch (6.4 cm) single screw extruder (model number: 2.5TMIII-30, obtained from HPM Corporation, Mount Gilead, Ohio), at a temperature of 199° C., resulting in a film having a thickness of 3 mils (80 micrometers) adhered to a polyester liner (2 mils (50 micrometers) thickness).

This film was stripped from its associated polyester liner, and corona charged by passing the film, while in contact with an aluminum ground plane, through a direct current (i.e., DC) corona charger equipped with a series of stainless steel wires at a voltage of +19 kilovolts. The wires were positioned at a distance of 1 inch (2.5 cm) from the ground plane, and were spaced such that the corona discharge was continuous. The film was exposed to the corona discharge for 34 seconds. The corona charged film was contacted with the polyester liner, the charged film and liner were rolled onto a take up roll, and stored under ambient conditions (i.e., 21° C. to 23° C., with relative humidity in a range of from 50 percent to 70 percent) for approximately 1 year. Pieces of the film were stripped from the liner immediately prior to use (FILM A).

Figure 2:
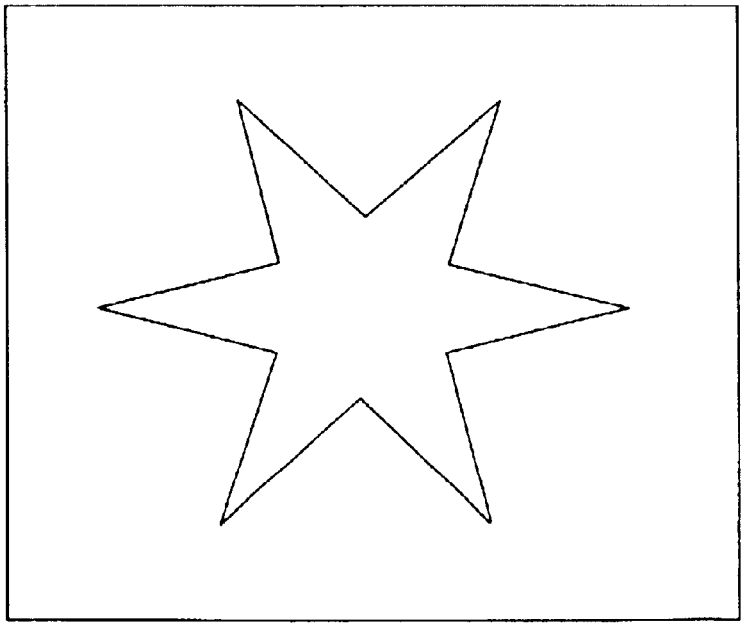
FIG. 2 is a top view of an exemplary stencil design according to one embodiment of the present invention.

A star-shaped opening (having a design as depicted in FIG. 2) was cut into an 4.8 inch×5.5 inch sheet of FILM A using a razor blade and a cutting mat while being careful not to tear, distort, or leave noticeable burs along the cut edge. A basswood panel was rough cut to approximately 8 inches×5 inches×¼ inch (20 cm×13 cm×0.6 cm) in size and sanded on the side to receive the stencil with 240 grit sandpaper until the surface was smooth to the touch. Dust was wiped from the substrate using a damp cloth, and the substrate was allowed to dry before proceeding.

The stencil was then placed on the wood substrate and smoothed by hand to remove wrinkles and bubbles in the film and to ensure close contact between the substrate surface and the electret film. The stencil was then slid by hand to the desired final position. The stencil was prevented from moving relative to the wood by hand, and was rubbed around the edges of the star cutout using a cloth (commercially available under the trade designation "SCOTCH-BRITE HIGH PERFORMANCE CLEANING CLOTH" from 3M Company, St. Paul, Minn.) while being prevented from shifting relative to the substrate.

The electret stencil was allowed to sit for 20 seconds before the decorative media was applied. Stencil paint (mistletoe green, obtained under the trade designation "STENCIL DECOR PRIMARY PAINT SET", Part No. 26080, from Plaid Enterprises, Norcross, Ga.) was applied using a stencil brush (obtained under the trade designation "STENCIL DECOR STENCIL BRUSH", Part No. 29202, from Plaid Enterprises) whose tip was dipped in the paint and blotted on a clean paper towel to remove most of the paint. The brush was held vertically, and then blotted onto the basswood, through the star-shaped opening.

Following completion of painting, the film was carefully peeled off the basswood substrate and the paint was allowed to dry. A reproduction of the star shape was obtained with good sharpness of the outer edge of the design.

Various modifications and alterations of this invention will become apparent to those skilled in the art without departing from the scope and spirit of this invention, and it should be understood that this invention is not to be unduly limited to the illustrated embodiments set forth herein.

What is claimed is:

1. A method of marking a substrate comprising:

providing an electret stencil comprising an electret film having a first major surface, a second major surface opposed to the first major surface, and at least one perforation extending through the film and connecting the first and second major surfaces;

providing a substrate having a surface;

electrostatically and removably adhering the stencil to the surface of the substrate;

applying a medium to the surface of the substrate through the at least one perforation of the stencil; and removing the stencil from the surface of the substrate.

2. The method of claim 1, further comprising rubbing the stencil with at least one of a film or a cloth.

3. The method of claim 1, wherein the stencil is in the form of a sheet.

4. The method of claim 1, wherein the electret film comprises a poly(ethylene-co-methacrylic acid) ionomer.

5. The method of claim 1, wherein the electret film comprises a zinc poly(ethylene-co-methacrylic acid) ionomer.

6. The method of claim 1, wherein the medium comprises wax.

7. The method of claim 1, wherein the applying comprises rubbing.

8. The method of claim 1, wherein the applying comprises painting.

9. The method of claim 8, wherein the painting comprises spraying.

10. The method of claim 1, wherein the medium is selected from the group consisting of pigment, chalk, paint, ink, a crayon, and a transfer sheet.

11. The method of claim 1, wherein the medium is a protective varnish.

12. The method of claim 1, wherein the medium is an etchant.

13. The method of claim 1, wherein the medium is a pressure-sensitive adhesive.

14. The method of claim 13, further comprising dusting the adhesive with a particulate solid material.

* * * * *

UNITED STATES PATENT AND TRADEMARK OFFICE

CERTIFICATE OF CORRECTION

PATENT NO. : 6,805,048 B2
DATED : October 19, 2004
INVENTOR(S) : Pearson, Scott D.

It is certified that error appears in the above-identified patent and that said Letters Patent is hereby corrected as shown below:

Title page,
Item [56], References Cited, U.S. PATENT DOCUMENTS, delete "Wagenwood" and insert in place therefor -- Wagenvoord --; delete "6,208,445 B1 3/2001 Reime" and insert in place therefor -- 6,308,445 B1 10/30/01 Porraro --.
OTHER PUBLICATIONS, "Product Literature: "GLOWSTICKFACTORY.COM™"" reference, delete "Flow" and insert in place thereof -- Glow --.

Column 8,
Line 35, delete "the" following "through".
Lines 48, 50 and 52, delete "the" following "wherein".

Signed and Sealed this

Eighth Day of November, 2005

JON W. DUDAS
*Director of the United States Patent and Trademark Office*